US006165110A

United States Patent [19]

Gajda

[11] Patent Number: 6,165,110

[45] Date of Patent: Dec. 26, 2000

[54] RESISTANCE EXERCISE DEVICE

[75] Inventor: Robert S Gajda, East Dundee, Ill.

[73] Assignee: Smith & Nephew, Inc., Memphis, Tenn.

[21] Appl. No.: 09/174,229

[22] Filed: Oct. 16, 1998

(Under 37 CFR 1.47)

Related U.S. Application Data

[60] Provisional application No. 60/062,974, Oct. 17, 1997.

[51] Int. Cl.[7] ..... A63B 21/06; A63B 21/04

[52] U.S. Cl. ..... 482/102; 482/129

[58] Field of Search ..... 482/93, 94, 97–103, 482/112, 113, 121, 129, 130, 135

[56] References Cited

U.S. PATENT DOCUMENTS 4,154,441 5/1979 Gajda .

4,632,388 12/1986 Schleffendorf ..... 482/99

5,151,070 9/1992 Norman ..... 482/99

*Primary Examiner*—John Mulcahy

[57] ABSTRACT

Two embodiments of an exercise device are described and include a track along which a slidably mounted transducer moves as a user pulls a handle attached to a cable. The transducer is biased toward one end of the track by a force produced by a rope and pulley attached to weights or a set of elastic tubes. The cable passes through the transducer and anchors to the other end of the track such that the transducer is slid toward the other end of the track against the force when the handle is pulled. In a first embodiment, the track is curved. In a second embodiment, a linear track is rotatably mounted to provide angular adjustment and two slidable transducers are slid inward from each end of the track as the user pulls on respective cables.

4 Claims, 2 Drawing Sheets

FIG.1
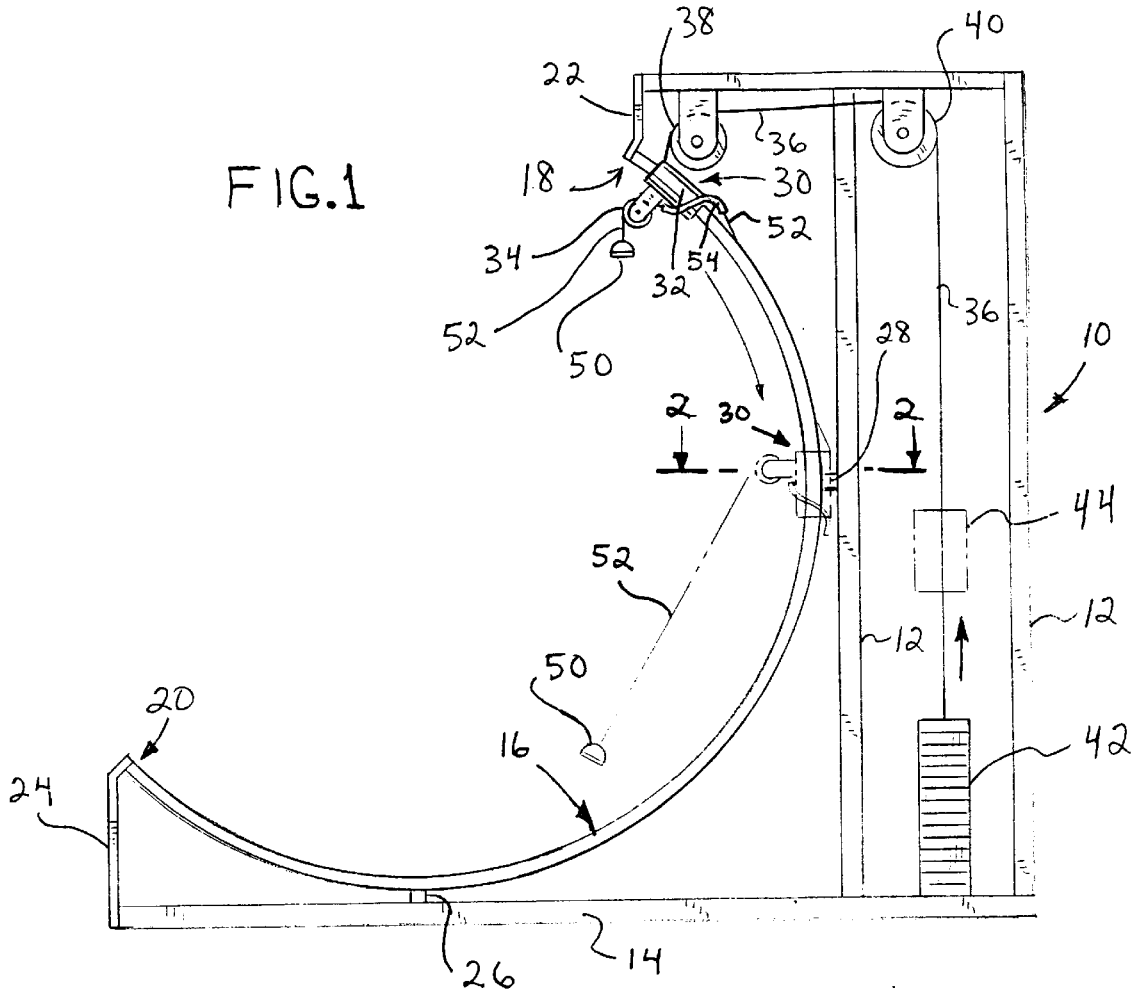
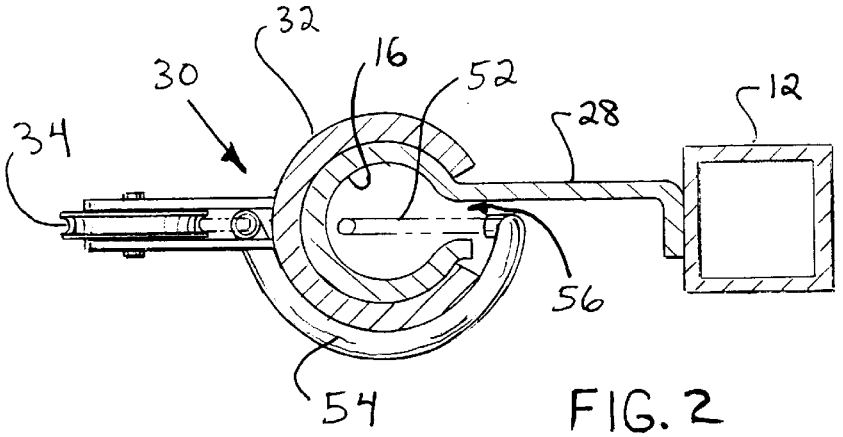
FIG. 2

RESISTANCE EXERCISE DEVICE

RELATED APPLICATION

This application is related to Provisional Application Serial No. 60/062,974 filed on Oct. 17, 1997.

BACKGROUND OF THE INVENTION

The present invention relates generally to an exercise device utilizing moveable weights. More particularly, the present invention is directed to an exercise device wherein the angle of application of force continuously changes during utilization of the exercise device.

Various types of exercise apparatus are known wherein a pulley and weights combination are used for limited range muscle development. In these prior art exercise devices, a line is led through a pulley or series of pulleys and its attached to a weight. A person using such devices for exercise must change the angle of the body to work a muscle from a different angle so as to compensate for the limit/range ratio. This usually results in incomplete muscle development due to limit of range. Physical structural imbalances develop as a result of a foreshortening of the over-developed muscle, causing structural imbalance. Correction of the structural imbalances usually can only be effected by developing or working an antagonistic muscle over a full range. It would be desirable to provide an exercise device which can be used for specific full range muscle development and wherein a range of muscles are developed by utilization of the exercise device.

SUMMARY OF THE INVENTION

The present invention is an exercise device which includes a track supported by a frame, a transducer slidably mounted to the track, resistance means connected to the transducer to provide a force which moves the transducer to one end of the track, a cable having one end anchored near the other end of the track and a second end connected to a handle, wherein the cable passes through the transducer such that when the handle is pulled by a user of the device the transducer slides along the track away from the one end and against the force produced by the resistance means.

In a first preferred embodiment, the track is curved such that the force required to pull the handle changes as the transducer slides along the curved track. As a result, the desired resistive force is provided over a full range of user arm motion.

In a second embodiment of the invention the track is linear and two slidable transducers are slid inward from each of its ends as the user pulls on respective cables. The resistance means includes elastic tubes that extend around pulleys on each end of the track and attach to the respective transducers. A desired resistive force is provided over a full range of motion of both arms as the transducers slide inward to stretch the elastic tubes.

DESCRIPTION OF THE PREFERRED EMBODIMENT

Figure 3:
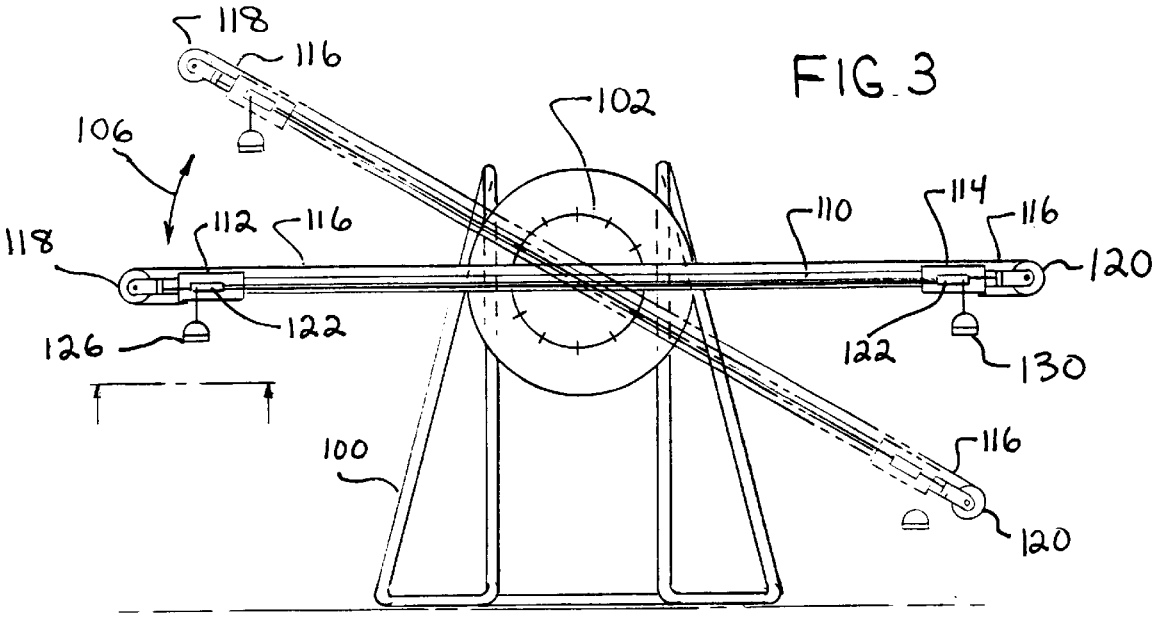

Referring particularly to FIGS. 1 and 2, a first embodiment of the exercise device includes a metal frame 10 having four upright members 12 and a horizontal member 14. A curved track 16 is secured to the frame 10 and extends in a substantially circular path between an upper end 18 and a lower end 20. The track 16 is fastened to the frame 10 by an upper bracket 22 which extends downward from the frame 10 and fastens to the upper end 18 of the track, and by a lower bracket 24 which extends upward from the frame and attaches to the lower end 20 of the track 16. Intermediate brackets 26 and 28 also fasten the track 16 to the frame 10 to provide rigid support for the track 16.

A transducer 30 is slidably mounted to the track 16 and is free to move through a range of motion from the upper end 18 to the lower end 20. As shown best in FIG. 2, the transducer 30 is comprised of a sleeve 32 which wraps around the cylindrical shaped track 16 and a pulley 34 which is fastened to the sleeve 32.

The transducer 30 is pulled upward on the track 16 by a cable 36 which fastens to its upper end. The cable 36 passes over two pulleys 38 and 40 mounted at the top of the frame 10 and extends downward from the pulley 40 to connect with a stack of weights 42. The force pulling the transducer 30 upward along the track 16 can be adjusted by selecting an appropriate number of the weights on the stack 42. When the transducer 30 is pulled downward along the track 16 the selected weights are lifted as indicated at 44.

The transducer 30 is pulled downward along the track 16 by a person (not shown in the drawings) using the exercise equipment. A handle 50 is connected to one end of a cable 52 that extends over the pulley 34 on the transducer 30 and is guided around to the opposite side of the transducer sleeve 32 by a guide member 54. A longitudinal slot 56 is formed along the length of the curved track 16 along its radially outward side. The cable 52 extends through this slot 56 and into the interior of the curved track 16. The other end of the cable 52 fastens at the lower end 20 of the curved track 16. When the person using the exercise machine pulls the handle 50 during an exercise motion, a force is produced which pulls the transducer 30 downward along the curved track 16. This downward movement of the transducer 30 lifts the selected stack of weights 42 upward to provide the resistive force for the exercise. Because the transducer 30 moves during the exercise, the direction and magnitude of the resistive force changes during the exercise.

Figure 4:
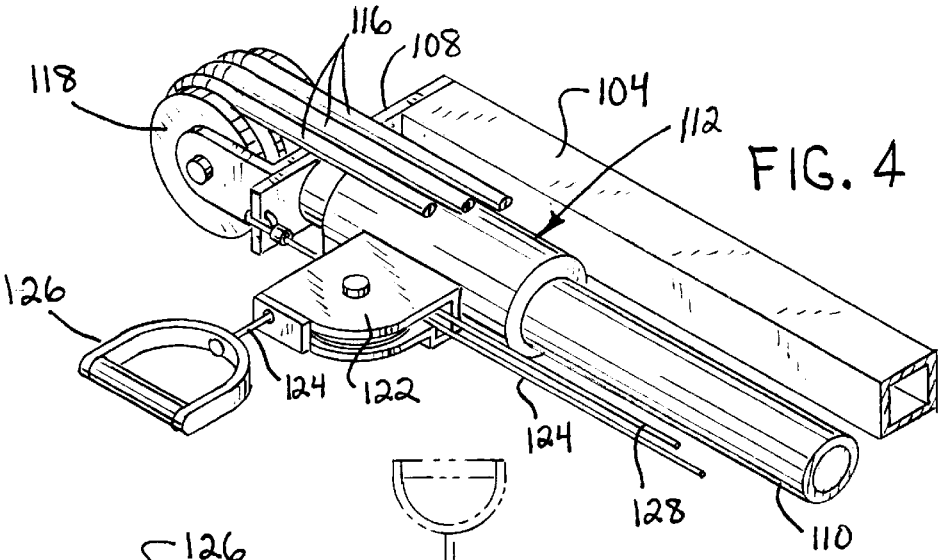
Figure 5:
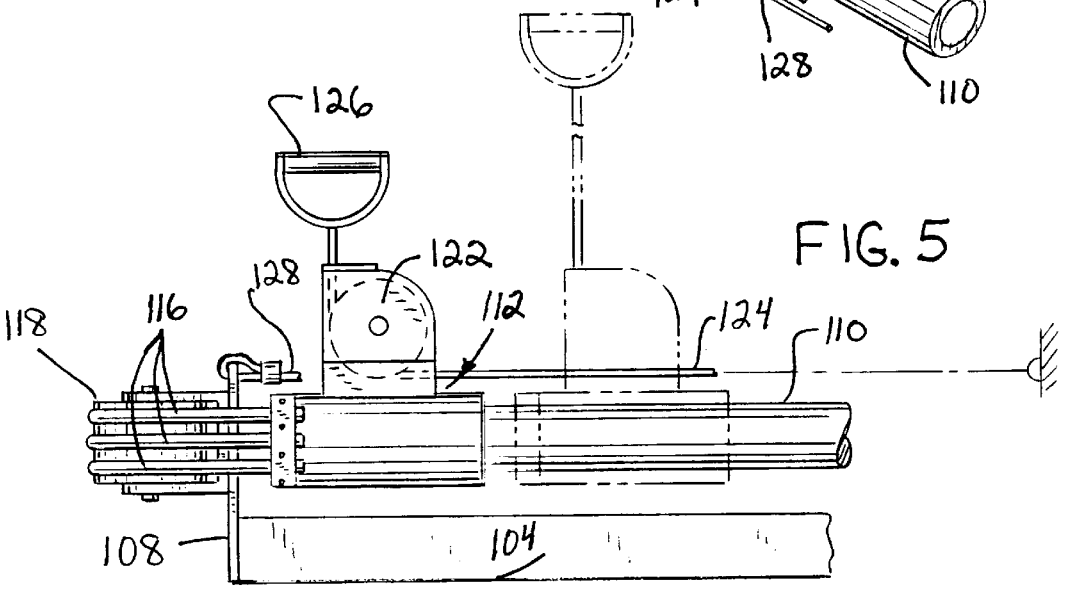

Referring particularly to FIGS. 3–5, a second embodiment of the resistance exercise machine is supported by a frame 100 that extends upward from the ground. A disc-shaped pedestal 102 is rotatably mounted to the frame 100 for rotation about a substantially horizontal axis. A beam 104 is fastened to the pedestal 102 and extends laterally outward therefrom in opposite directions. The angle of the beam 104 with respect to the ground can be adjusted as indicated by the arrow 106 in FIG. 3.

As shown best in FIGS. 4 and 5, brackets 108 connect to each end of the beam 104 and support between them a cylindrical shaped track 110 that extends the entire length of the track 104. Two transducers 112 and 114 are slidably mounted to the track 104, and each is connected to a set of three elastic tubes 116 as shown best in FIG. 5. The elastic tubes 116 are fed around corresponding sets of pulleys 118 and 120 mounted on the end brackets 108, and the elastic tubes 116 extend along the length of the beam 104. When either transducer 112 or 114 slides inward on the track 110, the elastic tubes 116 are stretched. The further they are stretched, the more resistance they offer to the sliding motion.

Each transducer 112 and 114 supports a pulley 122. A cable 124 having a handle 126 connected to one end is reeved through the pulley 122 mounted to transducer 112, and its other end connects to the bracket 108 at the opposite end of the beam 104. Similarly, a cable 128 with handle 130 is reeved through pulley 122 on transducer 114 and extends along the entire length of the beam 104 to connect with the bracket 108 on the opposite end. As shown best in FIG. 4, the cables are fed through, but do not wrap around the pulleys 122 at the ends where they are anchored to the end brackets 108.

A user standing in front of the pedestal 102 grasps the handles 126 and 130 and performs an exercise in which force is applied to pull the transducers 112 and 114 radially inward. A resistive force to this motion is provided by the elastic tubes 116 as they are stretched and the angle of this resistive force changes as the transducers 112 and 114 slide along the track 110.

What is claimed is:

1. An exercise device which comprises:

a frame;

a track supported by the frame and having first and second ends, the track extending along a curved path;

a transducer slidably mounted to the track;

resistance means connected to the transducer and being operable to produce a force which slides the transducer to one end of the track;

a cable having one end anchored near the second end of the track and extending through the transducer to connect at its other end with a handle;

wherein as a user of the exercise device pulls on the handle the transducer slides along the track toward the second end against the force produced by the resistance means.

2. The exercise device as recited in claim 1 in which the curved path is substantially circular.

3. The exercise device as recited in claim 1 in which the resistance means includes a second cable that extends over a pulley to connect with a selectable set of weights.

4. The exercise device as recited in claim 1 which includes a pulley mounted to the transducer and the cable engages the pulley as it passes through the transducer.

* * * * *